US008033336B2

(12) United States Patent
Benson

(10) Patent No.: US 8,033,336 B2
(45) Date of Patent: Oct. 11, 2011

(54) UNDERSEA WELL PRODUCT TRANSPORT

(76) Inventor: Robert A. Benson, Boston, MA (US)

( * ) Notice: Subject to any disclaimer, the term of this patent is extended or adjusted under 35 U.S.C. 154(b) by 0 days.

(21) Appl. No.: 12/729,738

(22) Filed: Mar. 23, 2010

(65) Prior Publication Data

US 2010/0175883 A1 Jul. 15, 2010

Related U.S. Application Data

(63) Continuation of application No. 11/413,358, filed on Apr. 28, 2006, now Pat. No. 7,703,535.

(60) Provisional application No. 60/703,961, filed on Jul. 29, 2005.

(51) Int. Cl.
*E21B 33/035* (2006.01)

(52) U.S. Cl. ..... 166/368; 166/369; 166/357; 166/345; 166/302; 141/82

(58) Field of Classification Search ..... 166/368, 166/366, 369, 357, 345, 347, 302; 405/167, 405/170; 141/386, 82
See application file for complete search history.

(56) References Cited

U.S. PATENT DOCUMENTS

| | | | | |
|---|---|---|---|---|
| 4,154,296 | A * | 5/1979 | Fijas | 165/179 |
| 4,967,843 | A * | 11/1990 | Corteville et al. | 166/366 |
| 5,284,581 | A | 2/1994 | Benson | |
| 5,286,376 | A | 2/1994 | Benson | |
| 5,427,680 | A | 6/1995 | Benson | |
| 5,676,848 | A | 10/1997 | Benson | |
| 5,888,407 | A | 3/1999 | Benson | |
| 6,070,417 | A | 6/2000 | Benson | |
| 6,079,498 | A * | 6/2000 | Lima et al. | 166/370 |
| 6,139,644 | A * | 10/2000 | Lima | 134/8 |
| 6,348,102 | B2 | 2/2002 | Clarke | |
| 6,364,940 | B1 | 4/2002 | Prueter et al. | |
| 6,412,135 | B1 * | 7/2002 | Benson | 15/104.062 |
| 6,513,385 | B1 | 2/2003 | Han et al. | |

(Continued)

FOREIGN PATENT DOCUMENTS

WO 00/25062 5/2000

(Continued)

OTHER PUBLICATIONS

Amin, "A Novel Approach for Treatment and Transport of Waxy Crude Oil in Single, Bare Subsea Flowlines, Phase I: Initial Demonstration," 2000 SPE Annual Technical Conference and Exhibition, SPE 62947, pp. 1-9 (2000).

(Continued)

*Primary Examiner* — Thomas Beach
*Assistant Examiner* — Matthew R Buck
(74) *Attorney, Agent, or Firm* — Kenyon & Kenyon LLP

(57) ABSTRACT

An apparatus and corresponding method of use extracts, cools, and transports effluents from subterranean, sub-sea oil formations to distant shore based processing facilities. The effluents, mostly crude oil, are conveyed rapidly to a cold flow generator near the oil wellhead on the sea bottom using the cold seawater to chill the effluents to a dispersed mixture including generated solids. The mixture is transported close to sea bottom temperatures, slowly, with small pressure drops, in low-cost submerged bare pipes over long distances to on or near shore processing facilities that can produce useful hydrocarbon products more cost effectively than at sea processing facilities. The apparatus eliminates or minimizes the need for heated or insulated pipe, the need for large floating processing structures, the need for sub-sea processing equipment, and/or the need for chemical additions to production flow.

24 Claims, 9 Drawing Sheets

U.S. PATENT DOCUMENTS

| | | | | |
|---|---|---|---|---|
| 6,533,030 | B2 * | 3/2003 | Mitrovic et al. | 165/184 |
| 6,536,528 | B1 | 3/2003 | Amin et al. | |
| 6,656,366 | B1 * | 12/2003 | Fung et al. | 210/737 |
| 6,752,214 | B2 * | 6/2004 | Amin et al. | 166/369 |
| 6,756,021 | B2 | 6/2004 | Botrel et al. | |
| 6,772,840 | B2 | 8/2004 | Headworth | |
| 6,774,276 | B1 * | 8/2004 | Lund et al. | 585/899 |
| 6,782,950 | B2 | 8/2004 | Amin et al. | |
| 6,973,948 | B2 | 12/2005 | Pollack et al. | |
| 7,261,810 | B2 | 8/2007 | Argo et al. | |
| 7,426,963 | B2 * | 9/2008 | O'Neill | 166/365 |
| 7,530,398 | B2 * | 5/2009 | Balkanyi et al. | 166/344 |
| 7,703,535 | B2 * | 4/2010 | Benson | 166/368 |
| 7,918,283 | B2 * | 4/2011 | Balkanyi et al. | 166/344 |
| 2004/0129609 | A1 * | 7/2004 | Argo et al. | 208/370 |
| 2005/0061395 | A1 * | 3/2005 | Pollack et al. | 141/388 |
| 2005/0178556 | A1 * | 8/2005 | Appleford et al. | 166/366 |
| 2006/0186023 | A1 * | 8/2006 | Balkanyi et al. | 208/263 |

FOREIGN PATENT DOCUMENTS

| | | |
|---|---|---|
| WO | 2008/056248 | 5/2008 |
| WO | 2008/056250 | 5/2008 |
| WO | 2008/056252 | 5/2008 |

OTHER PUBLICATIONS

Byrne et al., "Effective Wax Management to Enhance Production," Flow Assurance: A Holistic Approach, pp. 1-11 (2002).

Chin, "Cold Slurry Flow Technology and Its Impact on Deepwater Subsea Tieback," SPE International, The 8th Annual GoM Deepwater Technical Symposium, Presentation pp. 1-24.

Chitwood et al., "Techno-Economic Evaluation sof Deepwater Marginal Field Developments," Offshore Tecnology Conference, OTC 16722, pp. 1-9 (2004).

Larsen et al., "Cold flow—a Practical Solution," Proc. Of the 11th Int. Conf. "Multiphase 03," BHR group, San Remo, Italy, Jun. 11-13, 2003.

Sathananthan et al., "Flow (Cash) Assurance: A Smart Flow Assurance Solution to Enhance Production is 'Cold Flow'—the Answer to Long Distance Tie-Backs," Flow Assurance: A Holistic Approach, pp. 1-19 (2003).

Win et al., "Extended Tiebacks, the Future of the Deepwater Offshore Developments," Deep Offshore Technology, pp. 1-5 (2000).

Wolden, "Cold Flow for Very Long Multiphase Transportation Pipelines." SINTEF Petroleum Research, 2008.

Deepstar Program Report, "Phase IV, CTR 6901—Techno-Economical Evaluation of Marginal Fields Phase 2 Interim Report," Gulf of Mexico Deepwater Staged Recovery System, Deepstar Project, pp. 1-14 (2003).

"Introducing WaxEater™: New Flow Assurance Technology from Halliburton to Increase Profitability in Any Offshore Enironment." Halliburton Energy Services, Inc., 2000.

Halliburton Company 2000 Annual Report, p. 19.

"Halliburton Introduces New Flow Assurance Technologies." Press Release, May 1, 2000.

"Saturn Cold Flow." SINTEF Petroleum Research, Jul. 2008.

"New DEMO 2000 Contract Awards." Press Release, May 29, 2007.

* cited by examiner

UNDERSEA WELL PRODUCT TRANSPORT

RELATED APPLICATIONS

This application is a continuation of U.S. patent application Ser. No. 11/413,358, filed Apr. 28, 2006, which claims priority to, and the benefit of, U.S. Provisional Patent Application No. 60/703,961, filed Jul. 29, 2005. The disclosures of said applications are hereby incorporated by reference in their entirety.

FIELD OF THE INVENTION

The present invention relates to an apparatus suitable for connecting to an undersea well, converting the well's effluents to a cold dispersed mixture by means of a cold flow generator, and transporting such mixture of effluents by means of long conduits to an effluents processing facility, preferably on or close to shore.

BACKGROUND OF THE INVENTION

Generally, sub-sea hydrocarbon production is maintained at or near wellhead production temperature for ease of transport and processing. However, for oil and/or gas wells in deeper water, often far off-shore, the constant cooling effect of ocean water makes it difficult to maintain wellhead production temperatures without accruing expensive pipeline heating and/or insulating costs. As such, production from such sub-sea wells becomes economically unfeasible, especially for smaller reservoirs. Likewise, the cost of large surface facilities for processing warm production is substantial in deep water and can generally only be justified for relatively large hydrocarbon reservoirs. In addition, heating of a cooler flow using equipment on a floating structure is substantially more costly than heating the flow at a shore-based facility.

Equipment and controls for current undersea well production and processing are most often located at least in part on large floating processing structures, and/or drilling vessel structures. Floating structures in deep water and fixed structures in relatively shallow water are subject to the surface effects of storms and other natural events. Production risers to surface structures are likewise more subject to natural and intentional trauma. In addition, conventional structures are subject to accidental, or in rare cases intentional, damage by surface vessels, or the like. Generally, such floating structures are large and incur relatively substantial expense to drill, complete, work-over, process, and the like for such wells. Relative to shore-based facilities, floating structures are significantly more costly to operate on a per square foot basis or per unit weight basis.

One conventional solution for reducing the volumetric amount of well product that is transported through a pipeline, and therefore reducing the volumetric amount of product requiring heating, or other means, is to process the well product and remove undesirable components prior to transportation through the pipeline, water being an example. Equipment is installed on the ocean floor to process the well product and reduce the volumetric amount, and cost, of transport. Expensive equipment and controls are required for such processing.

Another conventional solution involves the addition of a variety of chemicals at or near the well-head to offset the negative effects of cooling effluents, such as the formation of sticky solids, waxes, gas hydrates, and the like that can slow or block flow. The additional cost, requirements of storage, and requirements for injection means of such chemicals, as well as removal of such chemicals during processing, can also add considerable expense to production.

SUMMARY

There is a need for an apparatus to eliminate the need for heated pipe well effluent transport, to eliminate or minimize the need for large floating structures, to eliminate or reduce the need for sub-sea processing equipment, to reduce the costs associated with transporting well product to shore, and/or to eliminate or reduce the need for chemical additions to production flow.

The present invention is generally directed to the provision of a cold flow generator at or near the wellhead for cooling, mixing and dispersing well product as it is extracted from the well, or shortly thereafter, utilizing a formation effluent extraction device. The effluents are then transported through relatively low cost sea bottom bare pipe flow lines, over long distances to conventional shore or near-shore facilities where processing of the effluents occurs and costs are greatly reduced. The size, material, and structure of the bare pipe flowline must be configured appropriately to enable aspects of the present invention. An alternative configuration of the present invention is the processing of the effluents after being cooled and prior to transportation. Such processing can occur on a sea-based structure. Some of the overall efficiencies and cost reductions of the inventive system may not be as attainable with sea-based processing structures. However, the present invention can be implemented with variation to several of its components, as would be understood by one of ordinary skill in the art.

In accordance with one embodiment of the present invention, an apparatus for extracting, cooling, and transporting effluents produced by an undersea well includes a formation effluent extraction device. A cold flow generator can be coupled with the formation effluent extraction device. Connectors can be provided to an on shore or near shore processing facility. The connectors can couple the cold flow generator and the processing facility together, such that effluents extracted from the undersea well are cooled by the cold flow generator and transported to the processing facility for processing. The on shore or near shore processing facility is substantially more proximal to the shore relative to the undersea well.

In accordance with aspects of the present invention, the formation effluent extraction device can be formed of a wellhead. The cold flow generator can utilize seawater to cool the effluents. The cold flow generator can mix the effluents to reduce separation. The components forming the apparatus can be of a uniform size independent of undersea well location and effluents production characteristics, such that same component types are removable and replaceable interchangeably. For example, the connectors can be formed of pipeline, and/or jumpers. Additionally, the cold flow generator can be modular.

The undersea well can be located proximal to a sea floor. The formation effluent extraction device can be coupled to the cold flow generator with an extracting connector, and the cold flow generator can be coupled to the processing facility with a transporting connector. The inner diameter dimension of the transporting connector can be greater than the inner diameter dimension of the extracting connector. The length dimension of the transporting connector can be greater than the length dimension of the extracting connector by at least a multiple of three. The cold flow generator can operate with a seawater temperature of less than an average temperature of about 50° F.

In accordance with further aspects of the present invention, the apparatus can further include at least one pump disposed along the transporting connector to pump the effluents to the processing facility. The apparatus can be comprised of a plurality of wellheads. The apparatus can include a plurality of extracting connectors. The apparatus can include a plurality of cold flow generators. The apparatus can include a plurality of pumps located along the transporting connector. The apparatus can include a plurality of processing facilities. A plurality of apparatuses can be networked together for extracting, transporting, and processing effluents produced by a plurality of undersea wells. A pressure reducing device can be disposed in at least one of the connectors to reduce pressure of effluents flowing therethrough. A pressure reducing mechanism can be incorporated into the apparatus along a flow path of the effluents.

In accordance with further aspects of the present invention, at least one of the connectors can include an inner surface having a rifling feature, or land feature, along at least a portion of the connector length. The connectors can be configured to mix and disperse effluents flowing therethrough. A pulse generator mechanism can be disposed in the cold flow generator. The cold flow generator can also include a rifling or land feature. An umbilical can provide at least one of power or control function to a component of the apparatus.

In accordance with further aspects of the present invention, the apparatus can be configured to extract, cool, and transport effluents comprised of liquids, gases, and/or solids. The apparatus can be configured to transport effluents that are at least partially formed of, or are formed into, one or more components selected from a group of components comprising wax crystals, methane hydrate crystals, other hydrate crystals, scales, asphaltenic crystals, sand, and the like. The apparatus can operate at a system pressure of greater than or equal to about 500 psi.

In accordance with one embodiment of the present invention, a sub-sea apparatus for generating and transporting a stream of effluents produced from a sub-sea wellhead to a processing facility on or near to shore includes an extracting connector connecting a sub-sea well to a cold flow generator, the cold flow generator having a re-entry lumen, a heat exchanger long path, a wall conditioning shuttle, and a short path for inletting and outletting effluents, and containing a back flow preventing portion. The apparatus further includes a transporting connector connecting the cold flow generator to a pump, the pump connected to a plurality of pipes and a plurality of pumps, in sequence, forming the sub-sea apparatus.

In accordance with one embodiment of the present invention, a sub-sea apparatus for generating and transporting effluents for production of crude oil includes a plurality of single bore non-horizontally drilled and completed wells. A plurality of wellheads can be individually coupled with each of the plurality of completed wells by pipes or jumpers, forming a formation effluent extraction device. A plurality of cold flow generators can be individually coupled with each of the plurality of wellheads. A plurality of connectors can be coupled with the plurality of cold flow generators connecting the plurality of wellheads with at least one on shore or near shore processing facility. Components forming the apparatus can be of a uniform size independent of undersea well location and effluents production characteristics, such that same component types are removable and replaceable interchangeably.

In accordance with one embodiment of the present invention, a method of obtaining effluents for the production of fuel includes extracting effluents from an undersea well or formation. The effluents are cooled. The effluents are transported to an on shore or near shore processing facility.

In accordance with aspects of the present invention, the well can be located on an ocean floor. The well and corresponding components thereof and the apparatus can be of a standardized size. The effluents can be cooled through heat exchange with ocean water surrounding the apparatus. Transporting the effluents can include the effluents flowing through a plurality of connectors at an average rate of less than about 2 ft/sec.

Conventional sub-sea production wells target large or very high production rate capable reservoirs, which generally require or utilize large diameter wells, casings, completion systems, and the like, to generate maximum production rates for a given well and field over a relatively short period of time. The present invention can reduce the size and expense of much of such down-hole and sub-surface equipment by standardizing and reducing the size of such equipment to match closely the size and capacity of downstream components of the apparatus. Reservoir pressure is maintained over longer periods of time by the use of the apparatus for extraction of hydrocarbon well product. Furthermore, slower, steadier product withdrawal from the formation enables better natural re-pressurization through the existing geological structure of the formation. Likewise, the slower well production rate and concomitant withdrawing can reduce formation plugging and/or deterioration. The apparatus of the present invention can extend the producing life of a hydrocarbon reservoir and recover a high percentage of the reservoir's liquid hydrocarbon capacity relative to current conventional drilling and processing practices.

Conventional undersea flowlines generally move products processed or unprocessed as fast as practicable to prevent cooling, to drain a reservoir as rapidly as possible for immediate economic return and to minimize the size and resultant cost of pipeline. Frequently, current flowline rates exceed five feet per second velocity and often are at much higher velocity. High pressures are generally required. Wear and failure risk can be very high. The present invention considerably reduces the flow velocity in long flowlines, thus reducing wear and failure risk.

BRIEF DESCRIPTION OF THE DRAWINGS

The present invention will become better understood with reference to the following description and accompanying drawings, wherein.

DETAILED DESCRIPTION

Figure 1A:
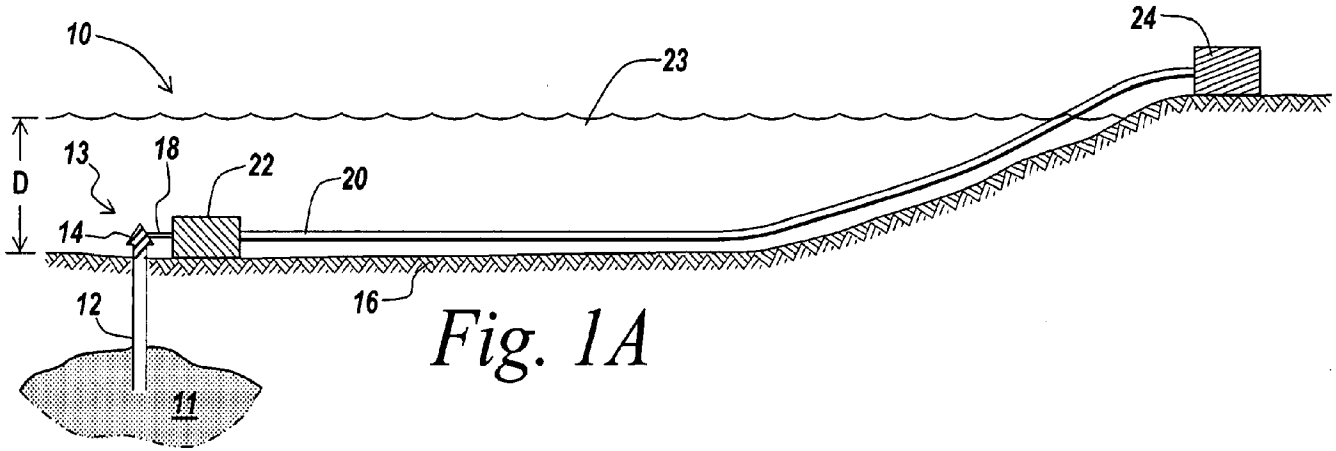
FIG. 1A is a diagrammatic illustration of an apparatus for extracting, cooling, and transporting well product, according to one aspect of the present invention.

An illustrative embodiment of the present invention relates to an apparatus for the undersea capture and transport of hydrocarbon well product (i.e., oil, gas, and the like) in a cost effective and efficient manner. In practice, hot production from a sub-sea well passes at an optimum pressure and flow rate into a non-plugging cold flow generator. This enables a cooled stable mass of the produced material in a dispersed mixture (typically with the oil acting as the carrier) exiting the cold flow generator to move slowly at optimum pressures through very long submerged pipe lines upward across the shallowing sea bottom to a shore based, and thereby more cost efficient, processing facility. At the shore based, or near-shore based processing facility, the cold dispersed mixture is processed into valuable products primarily crude oil, and its useful derivatives. The apparatus of the present invention eliminates the need for, or reduces the size of, many expensive, trauma prone floating offshore structures and vessels, as well as sub-sea processing equipment, and takes advantage of the relative chemical and mechanical inertness of well effluents that are cold, i.e., at or close to sub-sea temperatures. However, one of ordinary skill in the art will appreciate that aspects of the present invention are useful in achieving a portion of the advantages described herein, while still making some or full use of the floating offshore structures and vessels, as well as sub-sea processing equipment. Accordingly, a preferred embodiment of the present invention makes use of shore-based, or near shore processing practices, but the present invention by no means excludes embodiments utilizing offshore structures or vessels to implement at least a portion of the effluents processing.

In addition, the apparatus and method of the present invention can enable the use of standard sized, therefore less expensive, well strings, completion tubing, drilling and work-over vessels, wellhead equipment, drilling/completion methodology, and the like. Said differently, components of the apparatus can be of a uniform size independent of undersea well location and effluents production characteristics, such that same component types are removable and replaceable interchangeably. For example, a pipe section component, connector component, or other component forming the apparatus are uniformly sized and dimensioned for a plurality of apparatus installations. As such, the same equipment can be utilized to service and maintain the apparatus across multiple installations. Additionally, the components forming the apparatus 10 can be modular, in that the length or capacity of the apparatus can be changed merely by adding or removing components, and the components are interchangeable. The need for expensive horizontal or multilateral drilling can also be reduced. Components are preferably standardized for optimum installation, sub-sea servicing, control, and like functions. The components of the apparatus enable significant reduction in the size, complexity, and cost of the entire production stream from sub-sea reservoir to shore based processing facilities.

FIGS. 1A through 6C, wherein like parts are designated by like reference numerals throughout, illustrate example embodiments of a well product transport apparatus for extracting, cooling, and transporting well production according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

As utilized herein, the terms "cold", "cold flow", "cold slurry", "slurry flow", variations thereof, and the like, relate to a flow of effluents, well product, and the like in a temperature range of approximately that of the ocean floor, and thus includes a range of temperatures in part dependent upon the depth and location of the ocean floor. The terms as utilized herein are interchangeable. Sub-sea wells can exist at depths of one hundred feet or less to depths of greater than ten thousand feet, with the oil producing formations extending considerably deeper. Accordingly, ocean floor temperatures can vary, occasionally below 32° F., generally about 39° F., and occasionally over 70° F. However, well product temperatures, that is the temperature of effluents emerging from an undersea well, typically have temperature of greater than 100° F., often as high as 200° F., or even much higher. As such, the above-identified terms are intended to approach temperatures occurring at or near the ocean floor. The "cold", "cold flow", "cold slurry", and "slurry flow" temperature referred to herein can be any temperature below that of the well-head effluent temperature. The present invention makes use of the virtually infinite heat sink or cooling energy available through exposure of substantially all of the apparatus to the ocean water to create "cold", "cold flow", "cold slurry", and/or "slurry flow" using a cold flow generator, or similar device. Accordingly, the phrase "cold flow" generator is likewise intended to include and be interchangeable with "cold slurry" generator, "slurry flow" generator, and the like, as would be understood by one of ordinary skill in the art.

In addition, as utilized herein, the term "shore based", "on shore", "near shore", or variations thereof, when referring to processing facilities, are intended to include facilities or plants existing on land, as well as those existing near the shore, but in the water (ocean, river, lake, marsh, etc.). The term is intended to indicate those facilities or plants that are less costly to build, maintain, and/or operate, versus facilities or plants that are moored or fixed position floating structures extended distances from shore, or vessels, that are more expensive to build, maintain, and/or operate, or the like. Essentially, the "shore based" facility or plant is closer to land, or on land, and as a result is more economically feasible. Accordingly, the term "shore based", and the above-noted variations, do not limit the location of the facility or plant to be only on dry land, but can also include facilities or plants located in shallow water, as well, if the comparative costs to facilities on dry land are generally equivalent. In all instances, "shore based", and equivalents thereof, do not include deep sea vessels or floating structures that are located substantial distances from the shore. The "shore based" terminology utilized herein is well understood by those of ordinary skill in the art.

FIG. 1A illustrates a well product transport apparatus 10 in accordance with one example embodiment of the present invention. Effluents from an undersea hydrocarbon producing formation 11 are channeled into production tubing forming a well 12. The production tubing of the well 12 enter a wellhead device 14 on or proximal to a sea floor 16 of a body of water such as an ocean or sea 23. The wellhead device 14 can be a simple pipe, or can be a more complex collection of pipes, valves, controls, and the like. Seawater depth (D) can vary from hundreds of feet to greater than ten thousand feet. The effluents can contain a wide variety of components, including crude oil, gases, water, small particulates, and the like. The temperature of the effluents is typically greater than 100° F., and often greater than 200° F. An extracting connector 18 couples with the wellhead device 14 and directs the effluents at a pressure and flow rate suitable for the formation 11 and the well 12. The flow is preferably turbulent. In accordance with one example embodiment, the flow rate velocity is greater than an average of 2 ft/sec through the extracting connector 18.

The extracting connector 18 can be a bare pipe or jumper of suitable size and material of construction to handle the flow of effluents. Alternatively, the extracting connector 18 can be as minimal as a mere coupling between the wellhead device 14 and a desired processing device. The length of the extracting connector is short relative to that of a transporting connector 20, which serves to transport the effluents to a processing destination as described below. The length of the extracting connector 18 can be determined based on a number of factors. For example, the function of the extracting connector 18 is to efficiently move the effluents from the well 12 or wellhead device 14 to a temperature reducing device, such as a cold flow generator 22, as described below. The extraction connector 18, in most preferred implementations, is sized to receive the hot effluents and convey them without cooling them to such a degree that precipitates, waxes, gas hydrates, or other solids begin to form and slow down or block the flow of the effluents. Thus, such factors can be considered as temperature of effluents emitted from the well 12, temperature of the surrounding sea water, thickness and insulative properties of the extraction connector 18, rate of flow of the effluents, diametric size of the extraction connector 18, and other factors as would be understood by one of ordinary skill in the art, when determining the length of the extraction connector 18. One specific example provides the extraction connector 18 at 100 linear feet long and rated at 6000 psi at 250° F. nominal 3 inch pipe size. The extraction connector 18 can be connected to a conventional horizontal wellhead tree at one end and the cold flow generator 22 at the other.

Ultimately, in most installations, the extraction connector 18 is preferably on the order of 20 ft to 100 ft in length, but it can be less than one foot (i.e., a mere coupling) to one mile or more in length. In addition, the insulative properties of the extraction connector 18 can be modified to be highly effective at containing heat, or could be supplemented with auxiliary heating that would enable the length of the extraction connector 18 to be substantially longer. In addition, supplemental protection could be offered in the effluents flow, such as chemicals or pigs, or other flow enhancing mechanisms, to address any slowing or blockage that may occur with an extended extraction connector 18.

The transporting connector 20 can be on the order of 50 miles of schedule 160 nominal 8 inch pipe laid on the sea floor. The transporting connector 20 can include additional lengths and sizes instead of or in addition to such a configuration, such as an additional 150 miles of schedule 80 nominal 8 inch pipe laid on the sea floor and continuing to shore and a downstream refinery. Most embodiments will more frequently have a ratio of at a minimum, 3:1 for length of transporting connector 20 to length of extracting connector 18. A substantial number of embodiments will have a significantly higher ratio of transporting connector 20 length to extracting connector 18 length (i.e., on the order of 500:1 or 1000:1, or more). The relative length of the transporting connector 20 to the extracting connector 18 is ultimately inconsequential to the inventive concept. These ratios and examples are provided merely for providing approximate scale of an actual installation of the inventive well product transport apparatus 10, and relative length dimensions between various components of the well product transport apparatus 10.

Furthermore, the production tubing of the well 12, the wellhead device 14, and the extraction connector 18 can collectively be referred to as formation effluent extraction device 13. Alternatively, the formation effluent extraction device 13 can include just the production tubing of the well 12 and the wellhead device 14. In yet another alternative, the formation effluent extraction device 13 can be any combination of the production tubing of the well 12, the wellhead device 14, and the extraction connector 18. Generally, the formation 11 is tapped by the production tubing of the well 12, which can take a number of different forms, configurations, sizes, etc., as is understood by those of ordinary skill in the art. The wellhead device 14, as discussed above, can also take a number of different forms and configurations. Additionally, the extraction connector 18 has a number of different possible variations. All such forms, configurations, variations, and the like, of each of the production tubing of the well 12, the wellhead device 14, and the extraction connector 18, are collectively included and referred to herein with the phrase formation effluent extraction device 13. For purposes of the present invention, it is the end product of the formation effluent extraction device 13 that is conveyed to the cold flow generator 22 and continues with the process described herein. The present invention requires provision of the effluents from the formation 11 to be extracted in some manner. Accordingly, various implementations of the formation effluent extraction device 13 are discussed herein. However, the present invention is by no means limited to the illustrative embodiments of the formation effluent extraction device 13 described. There are numerous more variations and configurations of the formation effluent extraction device 13 that can be utilized in conjunction with the present invention, which are intended to be included within the scope of the present invention, as would be understood by those of ordinary skill in the art.

The jumper or extracting connector 18 carries the well produced effluents into the cold flow generator 22, which cools and mixes the effluents to a temperature relatively closer to, or approaching, the sea floor 16 temperature.

The cold flow generator 22 reduces the temperature of the effluents precipitating out solids forming materials such as wax crystals, methane gas hydrate crystals, and the like, and produces a dispersed flowable mixture of all of the produced effluents. During the cooling process the cold flow generator 22 uses mechanisms to mix and prevent blocking accumulations, such as those devices described in U.S. Pat. No. 5,284,581, U.S. Pat. No. 5,427,680, U.S. Pat. No. 6,070,417; and U.S. Pat. No. 6,412,135, which are incorporated herein by reference. Since the removal of heat from the effluents is essentially completed prior to exiting from the cold flow generator 22 there is little or no energy loss impetus to cause further precipitation of solids or blocking structures in the materials in the transporting connector 20 or long pipe. The cold effluents enter the transporting connector 20, which transports/conveys the effluents at a relatively slower flow velocity than that in the extracting connector 18 along or proximal to the sea floor 16, rising in depth generally in conformity with shallowing waters, and ending at an appropriate shore based processing facility 24 on or close to shore.

The average effluents flow velocity within the components of the cold flow generator are generally greater than 1 ft/sec and less than 10 ft/sec. The flow rate velocity in the transporting connector 20 is relatively low, such as an average of more than one foot per second less than in the extracting connector 18, or by example, less than one foot per second in a nominal 8" pipe at about 1000 SSU equivalent viscosity and at a 5000 Barrels of Liquid Per Day (BLPD) flow rate. The pipe can have internal friction approaching that of nominal new steel pipe producing a line pressure drop of about 5 feet liquid [$H_2O$] head per 1000 linear feet of pipe. At an assumed ocean depth of 4000 feet at the wellhead, such a pipe configuration enables the effluent pressure at the wellhead device 14, at, by example 8000 psi, to transport the effluents long distances to the shore based processing facility, in this example over 500 miles, arriving at such facility at greater than 500 psi. It should be noted that the above sizes, dimensions, and rates, and others provided herein, are merely exemplary of some possible embodiments of the present invention. They are by no means intended to limit the invention to the sizes, dimensions, rates, and the like, provided.

Figure 1B:
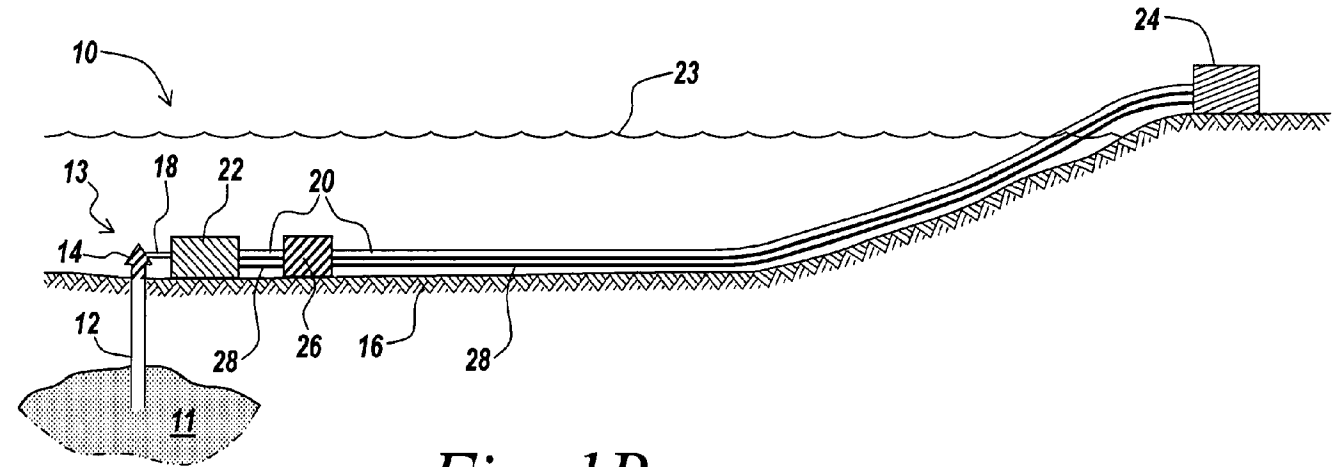
FIG. 1B is a diagrammatic illustration of an apparatus for extracting, cooling, and transporting well product in which a pumping mechanism is used, according to one aspect of the present invention.

In accordance with additional embodiments of the present invention, a well product transport apparatus 10 can include a number of different variations of components and configurations. One example is shown in FIG. 1B, which illustrates the addition of a first pump 26 positioned after the cold flow generator 22 as a part of the transporting connector 20. The addition of the pump 26 increases the distance the cold effluents can be transported. The pump 26 can also reduce the pressure necessary to produce effluents in the well 12 and enable further extractions of effluents from the basic reservoir or effluent producing formation 11 beneath the well. Power and control umbilicals 28 can be employed.

Figure 1C:
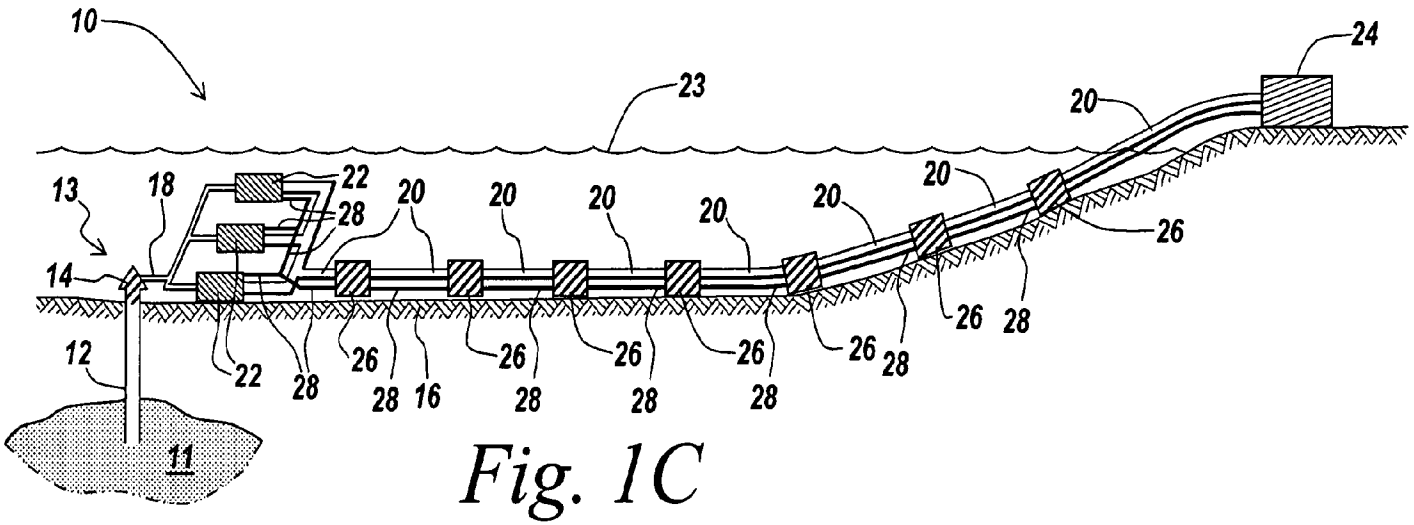
FIG. 1C is a diagrammatic illustration of an apparatus for extracting, cooling, and transporting well product in which multiplicities of components are used, according to one aspect of the present invention.

An additional embodiment of the present invention is illustrated in FIG. 1C, and includes a plurality of pumps 26 along, and contributing to the formation of, the transporting connector 20. The plurality of pumps further increases the distance the effluents can be transported. The pumps 26 can also be used to maintain optimum pressure and flow rate through the apparatus 10, or components thereof. For example, if a desired wellhead or reservoir pressure is about 6,000 psi and about 8,000 psi respectively, at a 5,000 BLPD flow rate with a pump 26 located 100 miles from the wellhead that requires a nominal 500 psi differential at 5,000 BLPD, the pump output can be increased or decreased to manage reservoir pressure and production as desired. The pump 26 can be centrifugal or positive displacement, and generally does not require multi-phase capability. In addition, the illustrative embodiment also includes multiple cold flow generators 22 networked together with appropriate sub-connectors (manifolds), and control and power umbilicals 28. The control and power umbilicals 28 can originate from the processing facility 24, or alternatively from other locations such as convenient floating or sub sea structures.

Figure 1D:
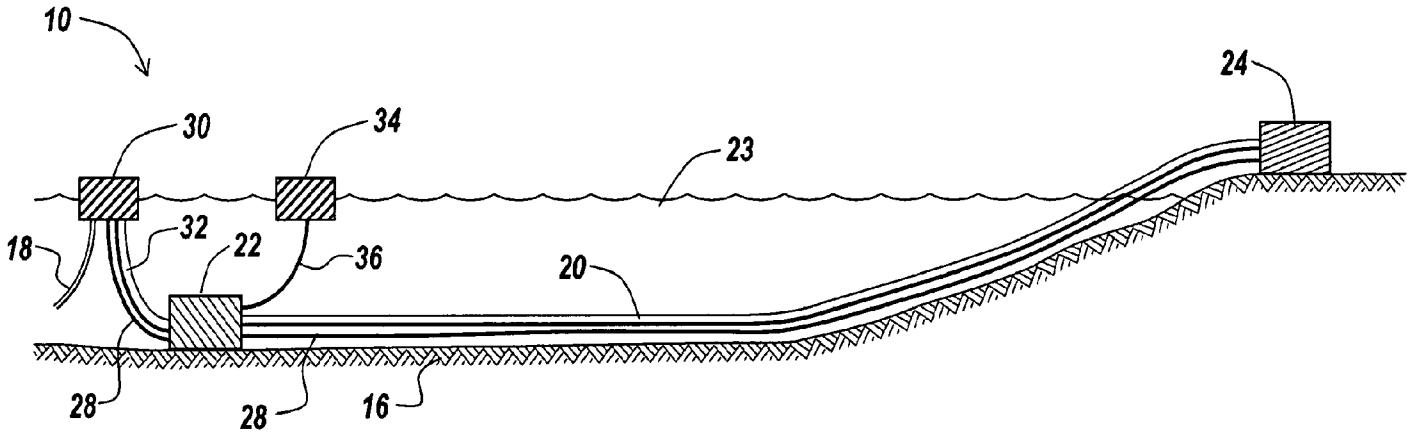
FIG. 1D is a diagrammatic illustration of an apparatus for extracting, cooling, and transporting well product in which floating structures are used, according to one aspect of the present invention.

The invention can also be employed as illustrated in FIG. 1D, wherein the hot flow of processed crude oil, that is crude oil essentially free of gases and/or water, from a floating processing platform or vessel 30 is directed through a surface-to-sea bottom connector 32 into the cold flow generator 22 for transport as a cold mass through the transporting connector 20 over a long distance along the sea floor 16 for further processing at the shore based processing facility 24. In this embodiment a plurality of pumps, connectors, and control/power umbilicals may selectively be utilized as shown in other figures.

Waxy crude oil can be efficiently transported at or proximal to sea floor or sea bottom temperatures with wax dispersed as non-sticky crystals. Likewise, gas that is produced from the effluents generally with a high methane content can be combined with well produced or other fresh or salt water at the floating processing platform or vessel 30, directed into the cold flow generator 22, and transported in the transporting connector 20 as a cold slurry to the shore based processing facility 24. Alternatively, the cold slurry can be directed to a vessel 34 via an application specific connector 36. An alternative embodiment of the cold slurrying of gas places the cold flow generator 22 in a cold water feed container on a floating processing platform of the floating processing platform or vessel 30, or the like.

It should be noted that the aforementioned cold slurry, cold flow, and/or slurry flow can be primarily processed crude oil, primarily a processed gas hydrate slurry, or a mixture of such slurries.

Figure 1E:
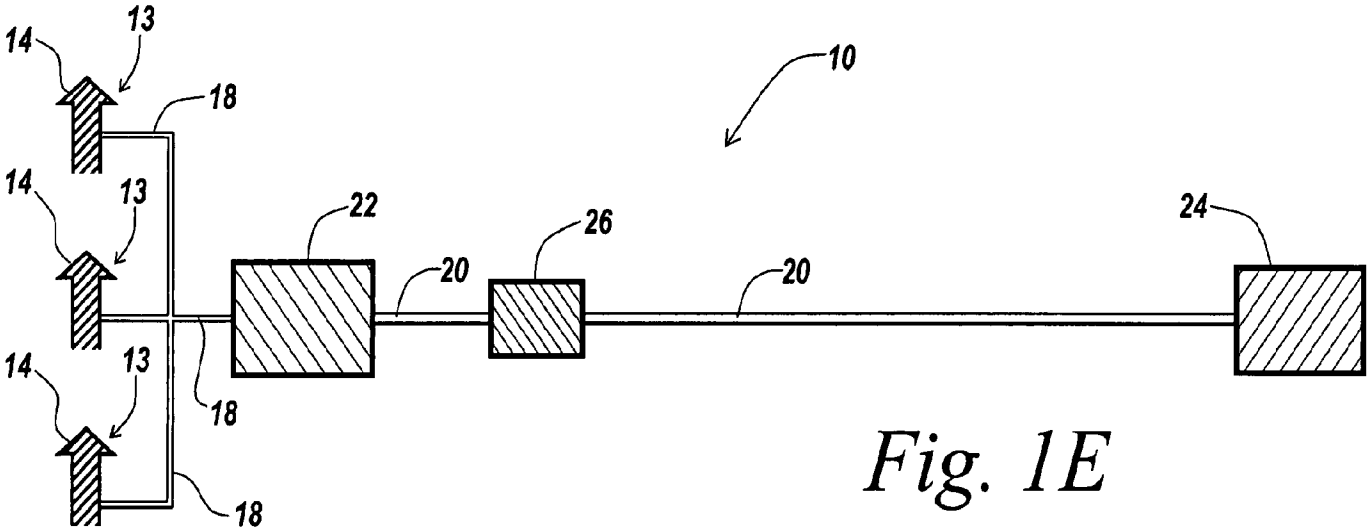
FIG. 1E is a diagrammatic illustration of an apparatus for extracting, cooling, and transporting well product in which multiple wells are served, according to one aspect of the present invention.

In accordance with yet another embodiment of the present invention, FIG. 1E shows a configuration wherein wellhead extraction devices, such as multiple wellhead devices 14 at multiple wells 12, connect with a cold flow generator 22. As with other embodiments, the multiple wellhead devices 14 can likewise connect with multiple cold flow generators 22 at a 1:1 ratio, 1:2, 1:3, or 1:N ratio, where a plurality of wells 12 feed effluents to each individual cold flow generator 22. The effluents then continue through the transportation system, potentially through pumps 26, and eventually to the shore based processing facility 24.

Figure 1F:
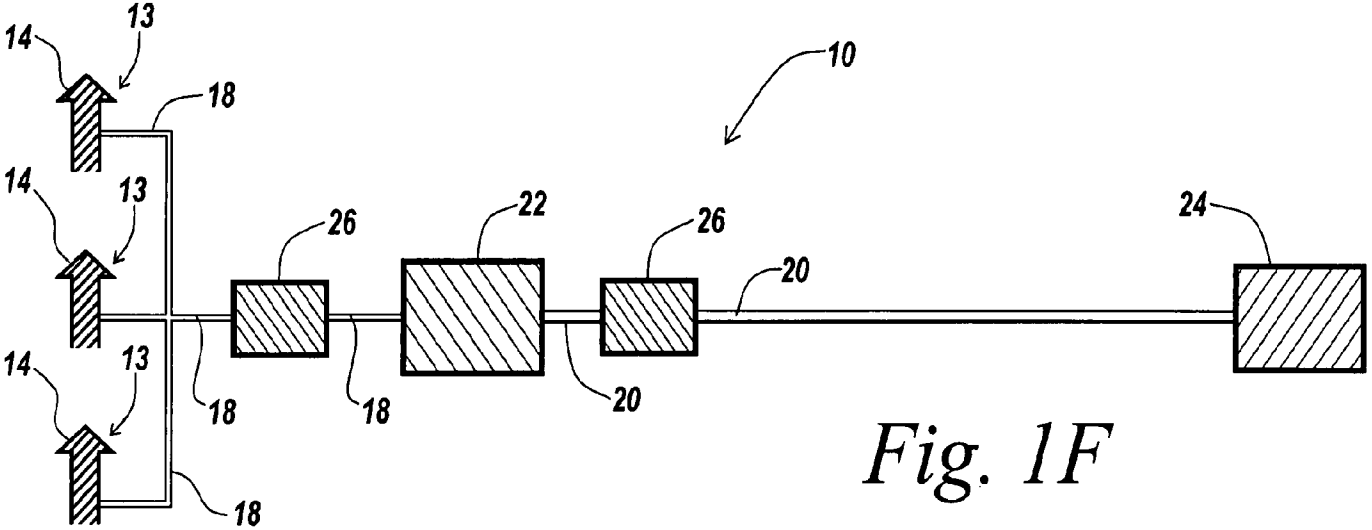
FIG. 1F is a diagrammatic illustration of an apparatus for extracting, cooling, and transporting well product in which multiple wells are served and an alternate pump configuration is provided, according to one aspect of the present invention.

In accordance with yet another embodiment of the present invention, FIG. 1F shows a configuration wherein multiple wellhead devices 14 at multiple wells 12 connect with a cold flow generator 22. As with other embodiments, the multiple wellhead devices 14 can likewise connect with multiple cold flow generators 22 at a 1:1 ratio, 1:2, 1:3, or 1:N ratio, where a plurality of wells 12 feed effluents to each individual cold flow generator 22. In this configuration a pump 26 is added prior to the cold flow generator 22, as a part of the extraction device in the area of the extracting connector 18, aiding in the pumping of effluents from the wells 12 to the cold flow generator 22. The effluents then continue through the transportation system, potentially through pumps 26, and eventually to the shore based processing facility 24.

Figure 1G:
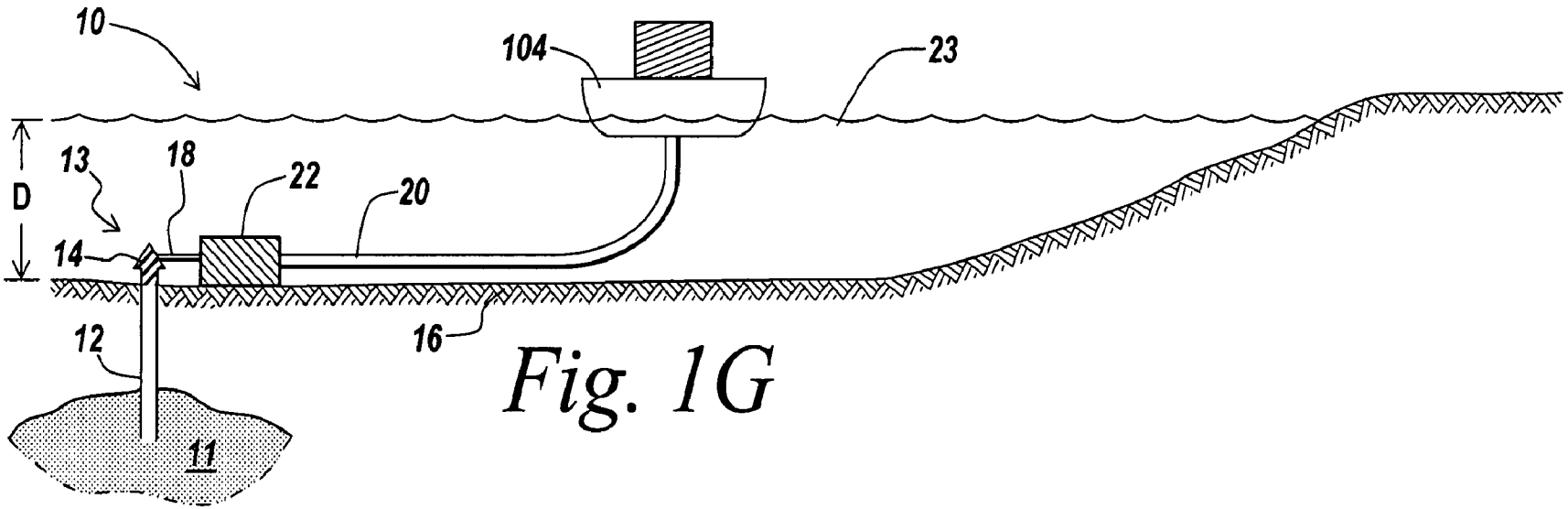
FIG. 1G is a diagrammatic illustration of an apparatus for extracting, cooling, and transporting well product in which a floating structure implements some processing of the well product, according to one aspect of the present invention.

FIG. 1G illustrates still another embodiment of the present invention, in which a floating structure 104 (i.e., a floating platform, a vessel, a spar, and the like) is added to form the complete well product transport apparatus 10. As previously mentioned, the preferred embodiment of the present invention performs processing of the effluents at a lower cost facility on or near shore. However, the present invention can make use of floating structures 104 to process the effluents. Thus, in the present example, effluents from the sea hydrocarbon producing well enter the production tubing of the well 12, the wellhead device 14, and the extracting connector 18 (collectively the formation effluent extraction device 13) for delivery to the floating structure 104. At the floating structure 104, the effluents are at least partially processed and then can be transported to shore either by pipe line or by vessel. Additional processing can take place on shore, if desired. In addition, the floating structure 104 can partially process the effluents and then pass the flow back down to the cold flow generator 22 to be cooled and then transported via the transporting connectors 20. This aspect of the embodiment is similar to that which was described and depicted in FIG. 1D previously.

It should be noted that the present invention is not limited to the specific embodiments illustrated. One of ordinary skill in the art will appreciate that each of the different variations of components and configurations illustrated can be combined and interchanged to form various networks or combinations of well product transport apparatus 10, such as number and placement of modular components including pumps, cold flow generators, connectors, and the like. Thus, the present invention anticipates all such variations and combinations too numerous to specifically illustrate herein.

Figure 2:
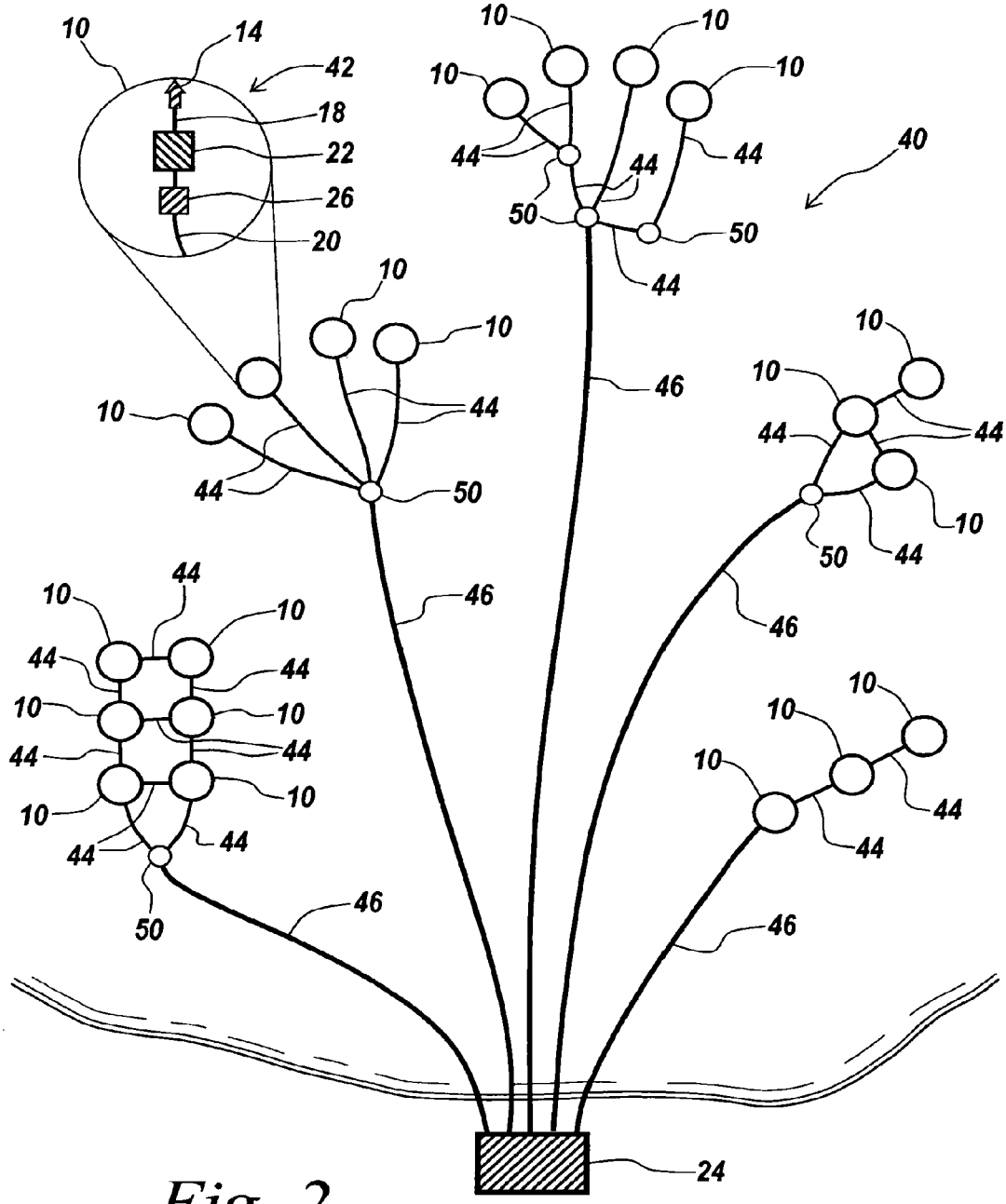
FIG. 2 is a diagrammatic illustration of an apparatus for extracting, cooling, and transporting well product in which a network structure is implemented, according to one aspect of the present invention.

FIG. 2 illustrates another embodiment in accordance with the present invention in the form of a system network 40 of the components previously described. By way of illustration a plurality of wells and well devices 14, extracting connectors 18, cold flow generators 22, pumps 26, and transporting connectors 20, combine together to form various configurations of the system network 40. The pumps 26 can form a part of the transporting connectors 20. Other components, such as umbilicals, can also be employed. A close-up 42 is shown of a typical well product transport apparatus 10 that combines to form the larger system network 40. As can be seen, each well product transport apparatus 10 connects with one or more other well product transport apparatuses 10 through a network element 44, such as a pipe. The network elements 44 can likewise combine or intersect at various junctions 50, such as a pump-and-connector element. The network elements 44, and the junctions 50, can eventually lead to a larger diameter network element 46, such as a larger diameter pipe, to transport the effluents to the adequately sized shore based processing facility 24. The flow rate in feet per second in the network elements 44 is normally lower relative to the flow rate in feet per second at any extracting connector 18, however, the opposite may occur where the flow rate at later network elements 44 can be greater than at a extracting connector 18. Each transporting connector 20 and any subsequent connectors can be many miles long. Additional pumps 26 can also be employed selectively in connectors network elements 44, 46.

Figure 3A:
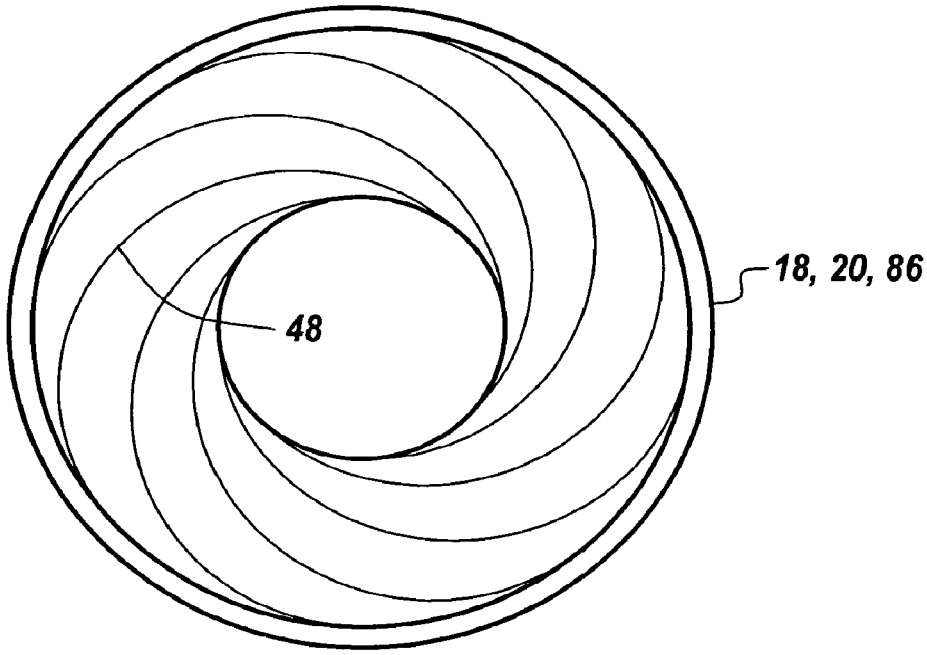
FIG. 3A is a perspective illustration of a rifled inner surface of a pipe for transporting well product or for use in a cold flow generator, according to one aspect of the present invention.
Figure 3B:
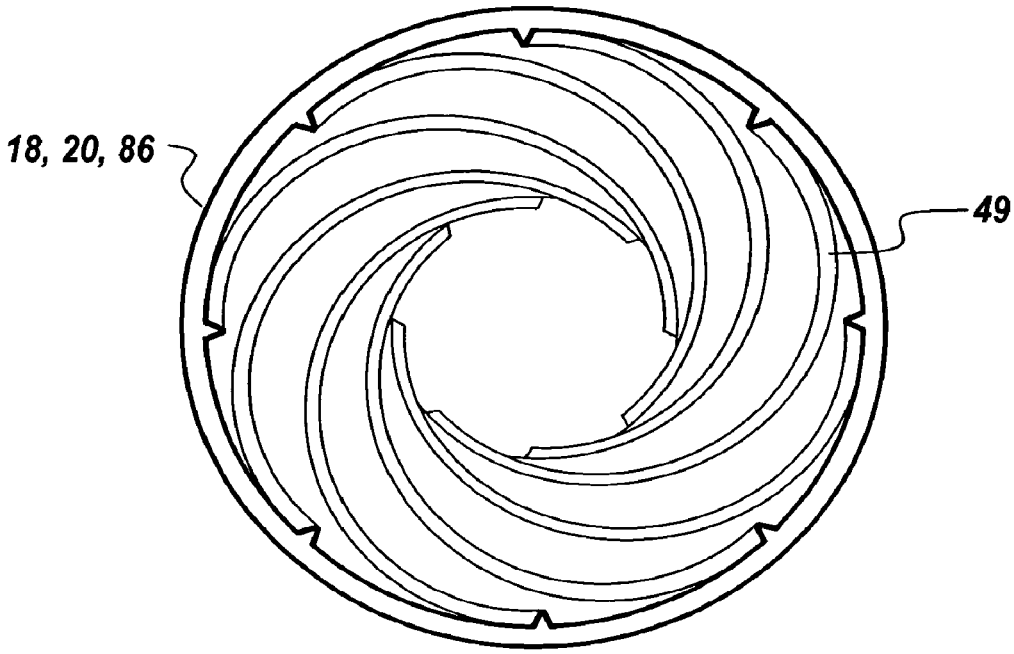
FIG. 3B is a perspective illustration of an inner surface of a pipe for transporting well product, or for use in a cold flow generator, the pipe having lands, according to one aspect of the present invention.

In accordance with aspects of the present invention, FIG. 3A shows one embodiment of a mechanism for slowly rotating the effluents as they progress through the various transporting connectors 20, or through portions of the cold flow generators 22. In a preferred embodiment the transporting connectors 20 and/or the cold flow generators 22 have spiraling troughs in the form of rifling 48 through their entire length. Alternatively, sub-portions of the transporting connectors 20 and/or the cold flow generators 22 can have rifling 48 characteristics. The rifling 48 can be formed on the inner wall of the transporting connectors 20 and/or the cold flow generators 22 directly, or can be formed with a spiraling insert of suitable material. Alternatively, spiraling projections, such as lands 49, can be formed on the inner wall of the transporting connectors 20 and/or the cold flow generators 22, as shown in FIG. 3B. The rifling 48, or lands 49, cause the slow rotation of the cold effluents as they are transported. The slow rotation helps maintain uniform dispersion over time and distance. Furthermore, such spiraling reduces any propensity of the effluents to separate and collect in high or low points of the connectors, particularly during a static flow condition. Along with other aspects described, and because of the reduction of effluent separation, this characteristic contributes to the ability of the present invention to mitigate production start-up problems after a planned or emergency shut-down or shut-in of well production.

In accordance with the above depicted embodiments, and with the invention generally, one specific example implementation of the present invention makes use of nominal sizes for the components that are uniform for optimum performance and economics. More specifically, the apparatus of the present invention can be constructed and implemented using a uniform or standardized set of drilling and completion components, and methodologies, by example for a vertical configuration. For illustrative purposes, a nominal flow of 5000 barrels of liquid (effluent) per well per day (5000 BLPD) is provided. In this example illustrative embodiment, each hydrocarbon producing well 12 is designed for extracting 5000 BLPD. Likewise, the wellhead 14 and corresponding choking apparatus is sized for 5000 BLPD. The extracting connectors 18 are sized for 5000 BLPD at turbulent flow velocities of greater than 2 feet per second. Each cold flow generator 22, or multiplicity thereof, is sized and configured at 5000 BLPD with the transporting connectors 20 sized at 5000 BLPD with a laminar flow velocity averaging less than 1 foot per second. Likewise, each pump 26 is sized and configured to operate at and maintain a nominal 5000 BLPD. In this example embodiment, when multiples of transporting connectors 20 are joined together with additional pumps 26, the transporting connectors 20 are sized for the sum of the capacities of earlier occurring connectors 20 in the overall network 40. In practice, the network 40 design can be dictated by limitations of standardized nominal sizes for downstream components of the network, e.g. eight standard 5000 BLPD components of 8 inch nominal pipe size would network into a nominal 40,000 BLPD transporting connector 20. Alternatively, 24 inch nominal pipe size and pump networking subsequently to a network element 46 and pumps at 80,000 BLPD design capacity, and 36" nominal pipe size. Standardizing in many similar patterns is anticipated in accordance with the present invention.

Components of the invention are preferably modularized for installation and maintenance, routine and emergency, by sub-sea means such as remotely operated vessels (ROVs), independently operated submersible vessels (IOVs), or other submersible vessels or apparatuses. Such components can include extracting connectors 18, formation effluent extraction device 13, cold flow generators 22, pumps 26, transporting connectors 20, and sub-components thereof, e.g. power and control umbilicals 28, and corresponding connectors and other components. It should be noted that the transporting connectors 20, being at substantially constant (or essentially non-fluctuating) temperature, do not require expansion/contraction provisions or related components. It is anticipated that such design features and others apparent to those familiar with the art enable unique utilization in sub-sea environments such as beneath Arctic ice or around potentially hostile geographical locations such as, by example, Nigeria or sub-sea volcanoes.

Figure 4:
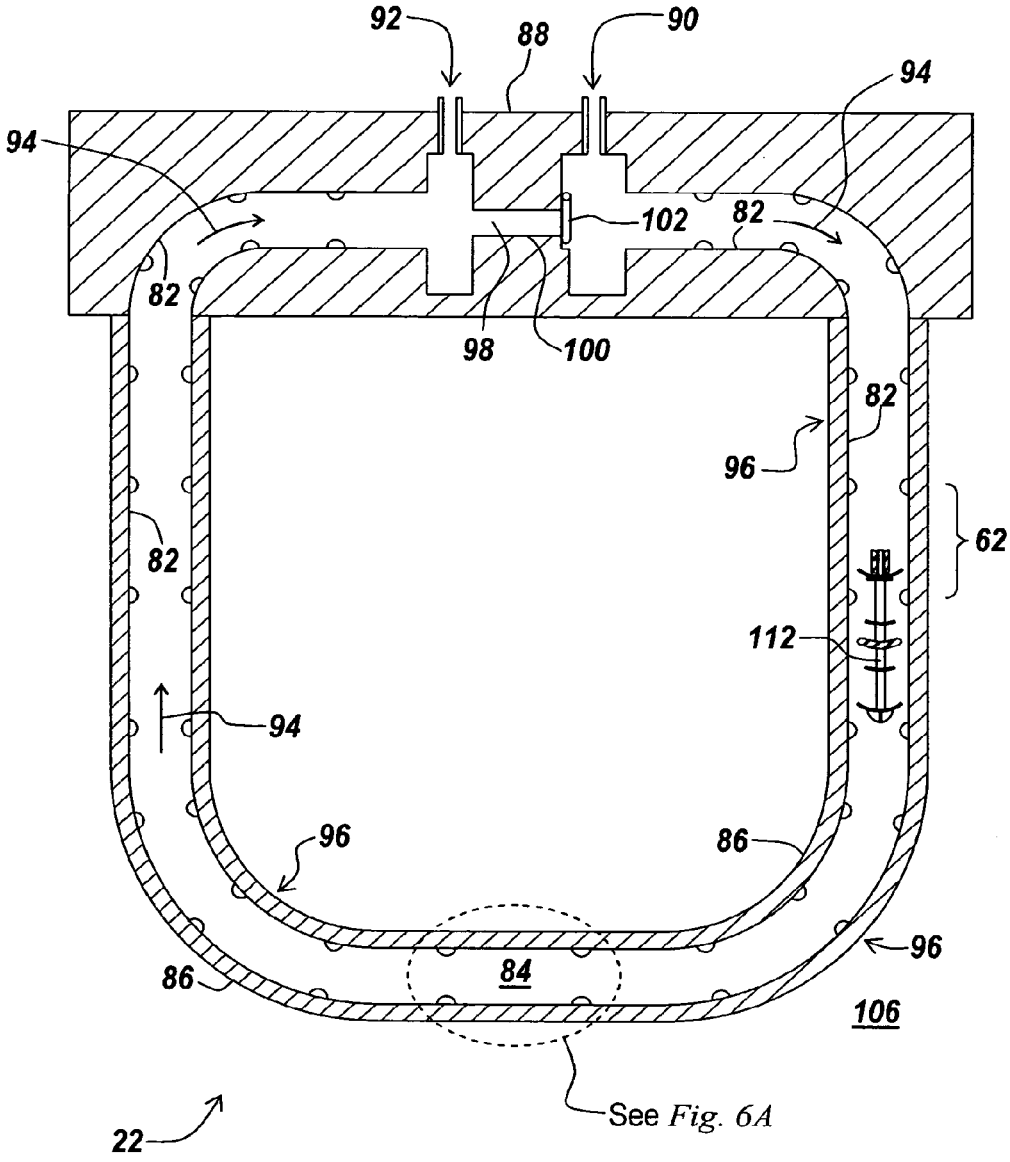
FIG. 4 is a diagrammatic illustration of a cold flow generator component of the apparatus for extracting, cooling, and transporting well product, according to one aspect of the present invention.

In accordance with one example embodiment of the present invention, a cold flow generator 22 is provided as one of the components that forms the well product transport apparatus 10. It should be noted that the following description of the cold flow generator 22 is merely descriptive of one example implementation of the cold flow generator 22. As utilized herein, the phrase "cold flow generator 22" can include the below described embodiment, as well as other cold flow generating embodiments and devices, as would be understood by those of ordinary skill in the art. With reference to FIG. 4, cold flow generator 22 includes wall 82 that defines a continuous reentrant lumen 84 passing through a processing wall 86 and a runner return structure 88. An inlet port 90 communicates with the reentrant lumen 84 as does an outlet port 92. A first path 94 passes through the reentrant lumen 84 from the inlet port 90 to the outlet port 92. The lumen wall 82 around the first path 94 includes a heat exchanging portion 96 which is made of thermally conductive material. The lumen 84 within heat exchanging portion 96 is advantageously of uniform cross-section. A shorter second path 98 through the reentrant lumen 84 from the inlet port 90 to the outlet port 92 is also defined, passing only through runner return structure 88.

The runner return structure 88 has a reduced portion 100 in which the cross-section of the reentrant lumen 84 is preferably less than that in the heat exchanging portion 96. Wall conditioning runner 112 is situated within lumen 84 and is free to move independently around the circuit of the lumen. The runner return structure 88 also includes a plug mechanism such as check valve 102 which blocks flow from the inlet port 90 through the second path 98 to the outlet port 92. In one example embodiment, the heat exchanging portion 96 is very long relative to the first path 94, and is immersed in the ocean water. Alternatively, a heat exchanger containment shell can enclose a space around the heat exchanging portion 96 of the lumen wall 82. It should be noted that the cold flow generator 22 depicted herein is merely representative of one form of cold flow generator. Other forms of cold flow generator can be utilized to generate the cold flow utilized in the apparatus of the present invention, such that the present invention is not limited to specific cold flow generator embodiments. Furthermore, preferred embodiments may be determined based on particular characteristics of the specific installation of the apparatus 10.

In operation, when installed in the ocean or sea, the seawater serves as the coolant fluid. Fluid from which a solid forms when the fluid is cooled is admitted through inlet port 90 and circulates through lumen 84 along path 94 and out through outlet port 92. The check valve 102 is normally closed and prevents flow through the second path 98. The effluents that have entered through the inlet port 90 as they circulate along the path 94 have heat extracted therefrom by contact with processing wall 86 and mixing fluids in the heat exchanger portion 96. As a result of this heat extraction, solids form from the circulating fluid and accumulate on the inside of processing wall 86 and within the effluents.

As fluid flows around the lumen 84 it sweeps the runner 112 along the flow path 94. As the runner 112 moves through the lumen 84 within the processing wall 86, the wall conditioning runner 112 clears accumulated solids from the wall surface through contact and turbulence so that solids do not build up on the wall but are carried along and mix with the flowing fluid as a slurry. The slurry flow moves slightly faster than the runner 112 because the runner 112 is slowed by repeated contact with the processing wall 86. This flow speed discrepancy contributes to turbulence and mixing of the effluents.

When the runner 112 is swept into the return structure 88, the runner 112 passes across the outlet port 92 and enters the reduced portion 100, deforming to assume a smaller periphery. Then the lead end of the runner 112 continues to advance, pushing open the check valve 102, passing across the inlet port 90, and entering the path 94 of the lumen 84. After the runner 112 has passed through the return section 88 it is swept by the flow through another circuit of the lumen 84 where it again clears the wall of accumulated solids and generates a turbulent, dispersed mixture, or slurry.

Figure 5A:
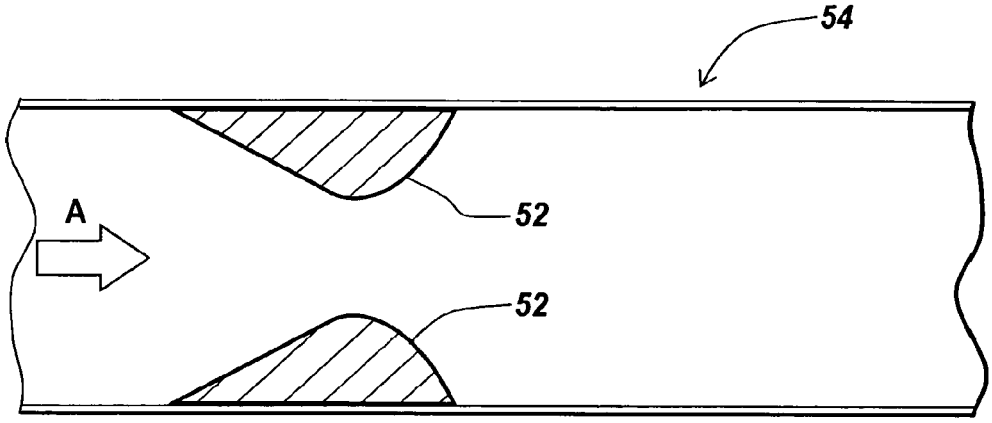
FIG. 5A is a diagrammatic illustration of a choking pressure reducing feature, according to one aspect of the present invention.
Figure 5B:
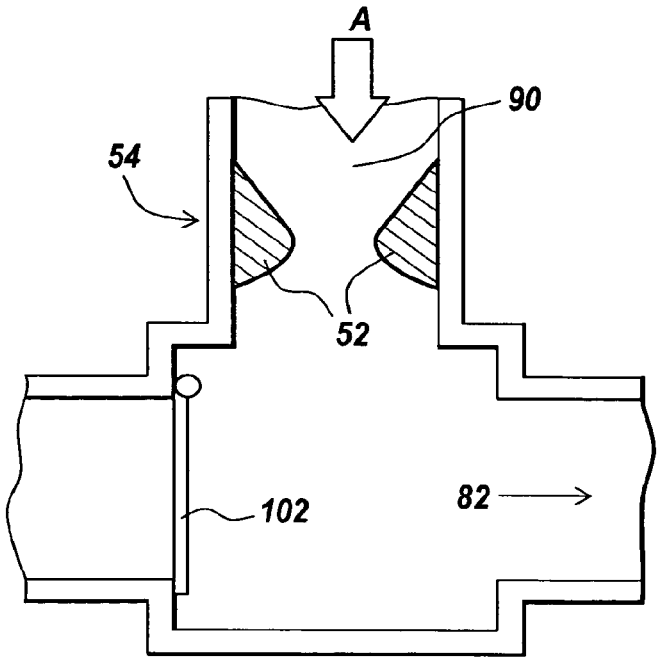
FIG. 5B is a diagrammatic illustration of an alternative configuration of the choking pressure reducing feature, according to one aspect of the present invention.

In accordance with aspects of the present invention, the extracting connector 18 and/or the cold flow generator 22 can provide pressure reducing mechanism 54, such as by way of reduced cross-section portions 52 as illustrated in FIGS. 5A and 5B. Such reduced cross-section portions 52 do not necessarily replace conventional primary pressure control mechanisms by choking at or prior to the wellhead device 14, or by other conventional means known to those of ordinary skill in the art. The pressure reducing mechanism 54 herein supplements and aids the conventional wellhead choking means. Pumps 26 as described herein in conjunction with extracting connectors 18 and cold flow generators 22 can provide pressure reduction and flow control capability in the overall optimization of the invention. Using the components of the well product transport apparatus 10 to reduce pressure at and near the wellhead devices 14 preserves reservoir pressure, a priori. Energy recovered from the produced hydrocarbons at the shore based processing facility 24 and used to power pumps 26 can be significantly less than that restored by natural means to the deep reservoir. For example, if the well product transportation apparatus 10 enables 20% more crude oil production from a 100 million barrel equivalent reservoir (i.e. 20 million barrels oil equivalent) such additional energy available is significantly greater than what is needed to provide and operate the pumps 26.

Figure 6A:
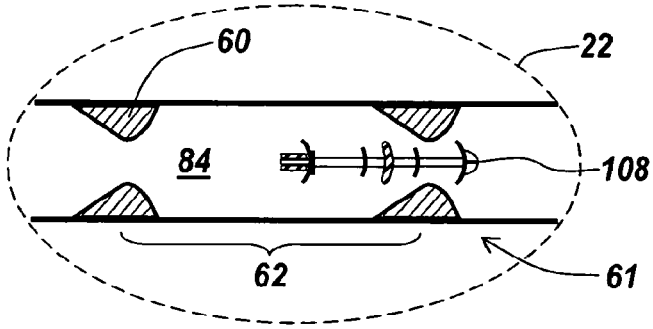
FIG. 6A is a diagrammatic illustration of a pulse generator within a cold flow generator, according to one aspect of the present invention.
Figure 6B:
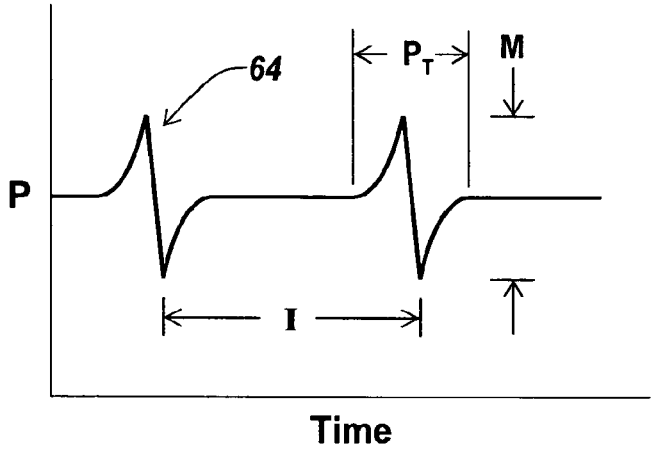
FIG. 6B is a chart showing a pulse, according to one aspect of the present invention.
Figure 6C:
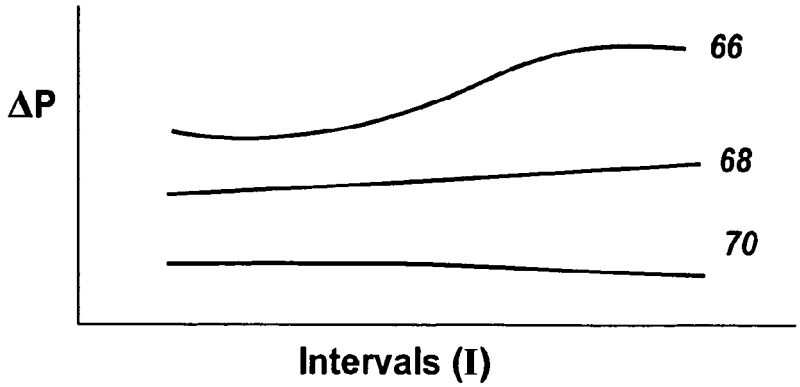
FIG. 6C is a chart comparing pulses of different cold flow materials, according to one aspect of the present invention.

In accordance with one example embodiment of the present invention, each cold flow generator 22 provides a unique coded signal useful to monitor and control the operation of the well product transport apparatus 10 and the well 12 in an optimal fashion. This can be accomplished as illustrated in part in FIG. 6A, wherein circumferential cross-sectional area reductions 60 or similar distortions spaced at selected intervals 62 in the cooling and flow portion of the cold flow generator 22 combining as a pulse generating mechanism 61 produce a pressure pulse. FIG. 6B is a graph illustrating the occurrence of a pressure pulse 64 as a typical shuttle or runner 112 moves within the cooling and flow portion of the cold flow generator 22 and passes an area reduction 60. Further illustrated in the figure is magnitude (M) of the pulse 64 at each interval (I), which corresponds with the selected interval 62. The magnitude M and shape of the pulse 64 is a function of the selected interval 62 and the changing rheology of the flow. The incremental time and pressure increases and decreases, and their respective rate of change over the period ($P_T$) of a pulse, determine the shape of the pulses 64 for analytical comparison with derived experimental and operational data. Thus, with different flow characteristics, the shape and curvature, magnitude (M), length of interval (I), and period ($P_T$) of the pulse on the graph of FIG. 6B will change. Analyzing these changes enables interpretation of the flow characteristics from these variables being measured and depicted in the graph. The pulses 64 of FIG. 6B are combined through a broad series of algorithms developed from experimental and operational data to provide control data curves, which by analysis show different effluent rheologies shown by oversimplified example in FIG. 6C as crystalline flow 66, light hydrocarbon flows 68, and water 70. In practice, the rheology and operational curves are very complex. However, the simple signal generation can be utilized as a control in the operation of the present invention. Such signal can also be utilized to monitor and control the sub-sea well. By example, the signal can provide an indication of gas or water in an effluent producing formation 11, as well as the rate of formation of differing slurries within the cold flow generator 22.

Conventionally, and prior to the present invention, in the course of extracting oil of a producing well at the highest possible rates, the influx of water and in some cases gas into the production tubing of the well 12 is often accelerated. The accelerated influx of water and/or gas prematurely limits the useful life of the field. By enabling a decrease in the rate of extraction in a given zone because of the slower nature of the extraction using the well product transport apparatus 10 of the present invention, the adverse influx of water and gas can be mitigated, thereby increasing the life of the well involved, the reservoir, and the total amount of oil extracted. Accordingly, the well product transport apparatus 10 of the present invention can minimize water and gas production.

Utilization of the well product transport apparatus 10 in accordance with the present invention can significantly reduce the amount of water and gas produced from a given oil formation/reservoir. As such, relatively small amounts of such fluid are available for re-injection. Natural replacement of fluids into the reservoir will substantially offset fluid volume and pressure withdrawn. If water injection, or in rare cases gas injection, is required other means can be utilized. An example alternative is sub-sea system salt water injection.

Current sub-sea field development production from exploration, drilling, completion, flow-line, riser, floating process platform, re-injection, transport by pipeline or vessel to refining facility ashore is generally designed to utilize the largest and best available component, often scaled up, of such equipment. Economies of scale of such equipment have dictated such design and utilization. The well product transport apparatus 10 of the present invention enables the overall design of sub-sea oil production to be based upon its unique characteristics, i.e., cold transport of produced components from formation to shore, simplifying the process, lowering costs, and increasing efficiency of fuel production. As previously mentioned, portions of the processing can be performed on floating structures, however, this may result in a lesser degree of cost savings being realized.

The present invention also provides environmental benefits, including little or no continued discharge from a traumatically ruptured transporting connector or transporter. There is little or no continued discharge because once shut down, the contained scurried effluents are highly viscous and have little or no impetus to flow into the sea from a rupture. Secondly, upon rising to the surface the viscous globs of effluent are less likely to spread upon the ocean surface. They are relatively safer and less costly to recover as well as less environmentally damaging.

Current sub-sea production is conventionally monitored and controlled by elaborate sensing systems, including electrical, fiber optic, and/or hydraulic umbilicals, as well as sensors and controls using a variety of sophisticated, complicated and expensive devices and equipment. Unique real-time operation data provided by the present invention utilizing its pulse generating capabilities enables optimum control, production, safety, maintenance parameters and the like for optimum performance and economics.

The present invention makes use of cold flow generators to cool and mix well product effluents prior to transportation for processing. The use of relatively slow and cold flow means there is little to no temperature gradient or temperature change over the length of the transportation pipeline (transporting connector), and therefore there is no expansion due to heat. With no expansion due to heat, there is a substantially reduced likelihood of pipe failure due to constant heating/expansion followed by cooling/contraction, which can cause fatigue. In addition, there is little to no lengthwise thermal expansion of the pipeline, which can also otherwise cause stress and fatigue. There is a reduced utility for expansion joints along the pipeline to remove stresses or buckling due to the reduced thermal stress resulting from the use of cold flow. Likewise, there is no need for insulation along the pipeline, since the cold flow within the pipeline is most often at or near seawater temperatures outside of the pipeline. There is additionally no requirement for heating devices to heat the pipeline back to the processing facility. All of the above considerations contribute to significantly reduced costs when implementing the well product transport apparatus versus conventional deep sea drilling, processing, and transporting installations.

The viscous dispersed mixture flow of the well product transport apparatus 10 reduces or eliminates the occurrence of the pooling of water in low points along the pipeline. This reduces the likelihood of the creation of hydrate agglomeration and plugging. With less hydrate plugging potential, the need for the injection of chemicals to maintain flow in the pipeline is eliminated or significantly reduced. In addition, the amount of wax and hydrates that do occur in cold flow are easily managed. By forcing the wax and hydrates out of their liquid form, and into a solid non-sticky phase, the wax and hydrates can be transported from the wells to the processing facilities without creation of clogs in the pipeline. The produced effluent is dropped to a temperature where the wax is no longer sticky and the hydrates have sufficient time to exchange enough energy to satisfy their heat of formation requirements.

In addition, the well product transport apparatus 10 of the present invention makes use of conventional basic non-heated pipe, and enables the use of polymeric pipe and pipe liners. Because the pipeline is not heated, and the effluent being transported is cooled, the production flow is substantially less likely to create material failure in polymer formed liners or pipes. Acidic and other negative chemical effects are also minimized in the present invention as the result of lower molecular activity in the design temperature regimes.

Use of the well product transport apparatus 10 of the present invention often includes pumps to overcome the increased viscosity of the cooled effluents. Use of the pumps extends the life of the well and supply field. As a natural effect of the reduction in temperature used to remove the wax and hydrates, the viscosity of the effluents increases. The increase in viscosity causes an increase in line friction, and therefore an increase in pressure drop over the length of the pipeline. While the transporting connector minimizes pressure drop by maintaining slow laminar flow to compensate for the pressure drop, pumps can maintain the line pressure at predetermined levels specifically designed for the life of the field, increasing the life and extending production.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the invention, and exclusive use of all modifications that come within the scope of the disclosed invention is reserved.

What is claimed is:

1. An apparatus for extracting, cooling, and transporting effluents produced by an undersea well, comprising:

a formation effluent extraction device;

a cold flow generator coupled with the formation effluent extraction device; and a transporting connectors coupled with an on shore or near shore processing facility;

wherein the transporting connectors couples the cold flow generator and the processing facility together, such that effluents extracted from the undersea well are cooled by the cold flow generator and transported to the processing facility for processing;

wherein the on shore or near shore processing facility is substantially more proximal to the shore relative to the undersea well, wherein the formation effluent extraction device is coupled to the cold flow generator at an extracting connector, and the cold flow generator is coupled to the processing facility with the transporting connector, and wherein an average inner cross-sectional area dimension of the transporting connector is greater than an average inner cross-sectional area dimension of the extracting connector.

2. The apparatus of claim 1, wherein the flow of the effluents through the formation effluent extraction device is turbulent.

3. The apparatus of claim 1, wherein the flow of the effluents through the transporting connectors is substantially laminar flow.

4. The apparatus of claim 1, wherein the formation effluent extraction device comprises production tubing, a wellhead, or a combination thereof.

5. The apparatus of claim 1, wherein the formation effluent extraction device comprises production tubing, a wellhead, and an extracting connector.

6. The apparatus of claim 1, wherein the cold flow generator utilizes seawater to cool the effluents.

7. The apparatus of claim 1, wherein the cold flow generator mixes the effluents.

8. The apparatus of claim 1, wherein components forming the apparatus are of a uniform size independent of undersea well location and effluents production characteristics, such that same component types are removable and replaceable interchangeably.

9. The apparatus of claim 1, wherein the formation effluent extraction device is located proximal to a sea floor.

10. The apparatus of claim 1, wherein the length dimension of the transporting connector is greater than the length dimension of the extracting connector by at least a multiple of three.

11. The apparatus of claim 1, wherein the cold flow generator operates with a seawater temperature of less than an average temperature of about 50° F.

12. The apparatus of claim 1, further comprising at least one pump disposed along the transporting connector and adapted to pump the effluents to the processing facility and control the rate and pressure of the flow of effluents.

13. The apparatus of claim 1, further comprising at least one pump disposed along the extracting connector and adapted to pump the effluents to the cold flow generator and control the rate and pressure of the flow of effluents.

14. The apparatus of claim 1, wherein the apparatus is comprised of a plurality of formation effluent extraction devices.

15. The apparatus of claim 1, wherein the apparatus is comprised of a plurality of extracting connectors.

16. The apparatus of claim 1, wherein the apparatus is comprised of a plurality of cold flow generators.

17. The apparatus of claim 1, further comprising at least one pressure reducing mechanism disposed in at least one portion of the formation effluent extraction device to reduce pressure of effluents flowing there through.

18. The apparatus of claim 1, wherein the transporting connector comprises an inner surface having a rifling or lands feature along at least a portion of the connector length.

19. The apparatus of claim 1, wherein the cold flow generator further comprises an inner surface having a rifling or lands feature along at least a portion of flow path through the generator.

20. The apparatus of claim 1, further comprising a pulse generator mechanism disposed in the cold flow generator.

21. The apparatus of claim 20, wherein the pulse generator mechanism comprises a plurality of cross-sectional area reductions.

22. The apparatus of claim 1, wherein the apparatus operates at a system pressure of greater than or equal to about 500 psi.

23. A sub-sea apparatus for generating and transporting a cooled stream of effluents produced from a sub-sea well to a processing facility on or near to shore, comprising:

an extracting connector connecting the sub-sea well to a cold flow generator, the cold flow generator having a re-entry lumen, a heat exchanger long path, a wall conditioning shuttle, and a short path for inletting and outletting effluents, and containing a back flow preventing portion; and transporting connectors connecting the cold flow generator to the processing facility, the transporting connectors comprising a plurality of pumps coupling a plurality of pipes together in sequence forming each transporting connector, wherein an average inner cross-sectional area dimension of the transporting connectors is greater than an average inner cross-sectional area dimension of the extracting connector.

24. A method of obtaining effluents for producing fuel using an apparatus for extracting, cooling, and transporting effluents produced by an undersea well, the method comprising:

extracting effluents from the undersea well;

cooling the effluents; and transporting the effluents to an on shore or near shore processing facility;

wherein a flow rate velocity of the effluents while extracted from the undersea well is greater than a flow rate velocity of the effluents while being transported to the on or near shore facility, wherein a formation effluent extraction device is coupled to a cold flow generator at an extracting connector, and the cold flow generator is coupled to the processing facility with transporting connectors, and wherein an average inner cross-sectional area dimension of the transporting connectors is greater than an average inner cross-sectional area dimension of the extracting connector.

* * * * *